US005854439A

United States Patent [19]

Almström et al.

[11] Patent Number: 5,854,439

[45] Date of Patent: Dec. 29, 1998

[54] METHOD FOR ELECTRICALLY INITIATING AND CONTROLLING THE BURNING OF A PROPELLANT CHARGE AND PROPELLANT CHARGE

[75] Inventors: Henrik Almström, Västerhaninge, Sweden; Gert Bjarnholt, Tyresö, Sweden

[73] Assignee: Forsvarets Forskningsanstalt, Stockholm, Sweden

[21] Appl. No.: 460,011

[22] Filed: Jun. 7, 1995

[30] Foreign Application Priority Data

Jun. 17, 1994 [SE] Sweden ..... 9402148-2

[51] Int. Cl.[6] ..... F41F 1/00

[52] U.S. Cl. ..... 89/8; 102/202.5

[58] Field of Search ..... 89/8; 102/202.5

[56] References Cited

U.S. PATENT DOCUMENTS

| | | | |
|---|---|---|---|
| 380,368 | 1/1888 | VanTine | 89/8 |
| 3,434,426 | 3/1969 | Dapper | 102/100 |
| 3,527,168 | 9/1970 | McCurdy et al. | 149/2 |
| 3,793,097 | 2/1974 | Lawrence | 149/5 |
| 4,072,546 | 2/1978 | Winer | 149/2 |
| 4,167,428 | 9/1979 | Sayles | 149/109.6 |
| 4,402,268 | 9/1983 | Usel | 102/202.5 |
| 4,410,470 | 10/1983 | Sayles | 149/109.6 |
| 4,956,029 | 9/1990 | Hagel et al. | 149/19.8 |
| 5,171,932 | 12/1992 | McElroy | 89/8 |
| 5,322,002 | 6/1994 | Miskelly et al. | 89/8 |
| 5,431,105 | 7/1995 | Wilkinson | 89/8 |
| 5,470,408 | 11/1995 | Nielson et al. | 149/109.6 |
| 5,612,506 | 3/1997 | Goldstein | 89/8 |

*Primary Examiner*—Edward A. Miller
*Attorney, Agent, or Firm*—Jacobson, Price, Holman and Stern, PLLC

[57] ABSTRACT

The invention relates to a propellant charge comprising a compact propellant and a method for electrically initiating and controlling the burning of such a propellant charge. Electrothermal energy is supplied to the propellant charge by feeding electric current over electrically conductive surfaces (6, 7, 19) in the propellant, and that said supply is made to different parts or zones (15) of the propellant charge at different points of time during the burning.

The invention specifically relates to a projectile propellant charge having a first end (9) facing the projectile (4) and a second end (10) facing the back (3) of the weapon. The electrothermal energy is then supplied to the propellant charge, beginning in the first end thereof and then successively to the second end thereof by feeding the current at each point of time over an axially restricted part (15) of the propellant charge.

12 Claims, 6 Drawing Sheets

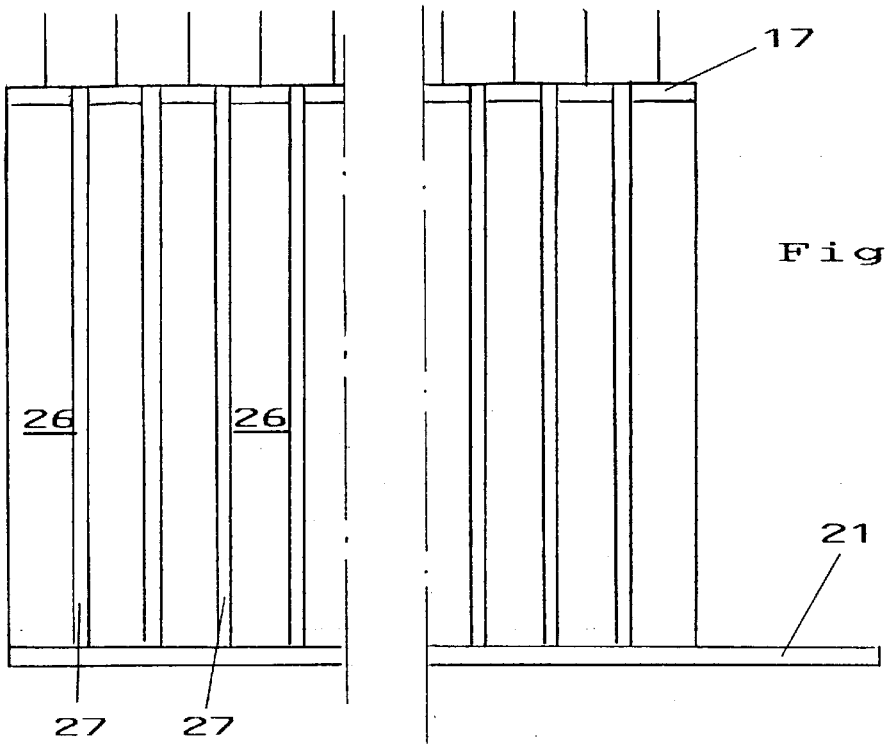
Fig 12
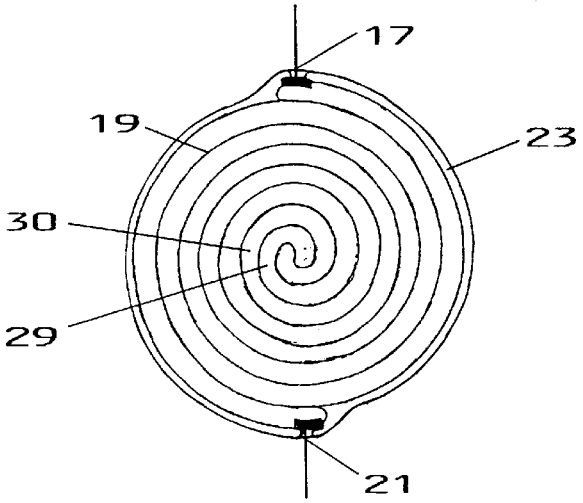
Fig 13
Fig 14
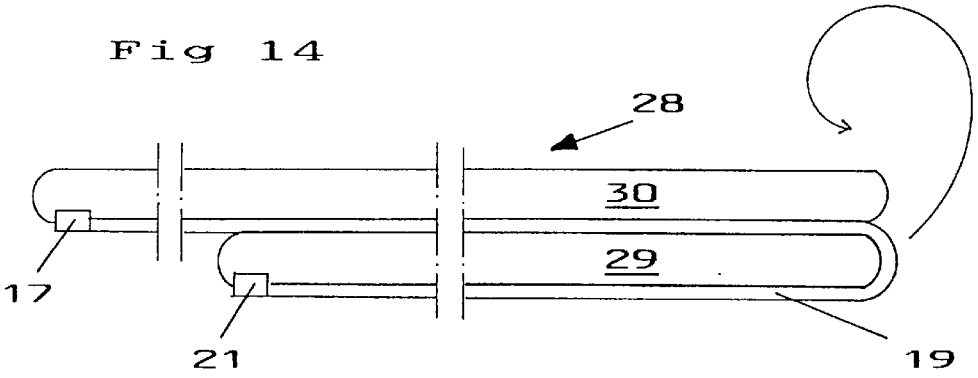

METHOD FOR ELECTRICALLY INITIATING AND CONTROLLING THE BURNING OF A PROPELLANT CHARGE AND PROPELLANT CHARGE

FIELD OF INVENTION

The invention relates to a method for electrically initiating and controlling the burning of a propellant charge, and a propellant charge for use in the method. More specifically, the invention relates to a propellant charge containing a compact propellant.

DISCUSSION OF PRIOR ART

The modern development of arms requires a higher energy density and a quicker burning process of the propellant charges to be used in guns and rocket motors. It should also be possible to control the energy output of a propellant charge over time, for instance, during the acceleration of a projectile in a gun barrel. Efficient burning in a gun is obtained if the pressure in the gun is at the design pressure for as long as possible.

In a conventional manner, a high specific burning rate (mass per unit of time dm/dt) in propellant charges is achieved by using porous and loosely packed propellants having a charge density of about 50% of the theoretical maximum density (TMD) of the propellant, which gives the required specific burning surface. However, this leads to a low energy density of the charge and restricts the practically possible amount of propellant in e.g. a gun.

Compact propellant charges having a density close to the TMD have a high energy density and can also be made to have higher mechanical strength than loosely packed charges. The problem of a compact propellant charge is, however, that the burning of the compact propellant mass takes a long time.

OBJECTS OF PRESENT INVENTION

One object of the present invention is to provide a high mass burning rate in a compact propellant charge.

A further object of the invention is to provide a method of combining the energy output of the propellant with the supply of electrothermal energy.

One more object of the invention is to increase the efficiency of a missile propellant charge.

These objects are achieved by a method and a propellant charge as defined in the claims.

SUMMARY OF THE INVENTION

The method according to the invention is characterised in that electrothermal energy is supplied to a propellant charge containing a compact propellant by feeding electric current over electrically conductive surfaces in the propellant, and that said supply is made to different parts or zones of the propellant charge at different points of time during the burning.

By the inventive method, a very high mass burning rate, dm/dt, can be obtained also in compact propellants having a density close to TMD. In propellant charges for guns and rocket motors, the energy density thus can be roughly doubled as compared with what is possible in the corresponding conventional charges.

In a propellant charge having an axial extent from a first end to a second end, the electrothermal energy can be supplied to the propellant charge, beginning in the first end thereof and then successively towards the second end thereof by feeding the current at each point of time over an axially restricted part of the propellant charge. This is advantageous especially in projectile propellant charges, when the first end (initiating end) of the propellant charge is facing the projectile and its second end is facing the back of the weapon. In such burning, a considerably higher efficiency can be achieved, defined as the quota of the kinetic energy of the projectile and chemically supplied energy from the burning of the propellant, as compared with what is achieved with a conventional projectile propellant charge. This is especially the case at high projectile velocities.

The inventive method for initiating and controlling the burning of the propellant charge also renders it possible to select more freely the explosive for the propellant charge. Explosives such as HMX, TNAZ and CL-20 may be used. They have a higher energy density than today's propellants based on NC/NG.

A propellant in compact form having a density of 90–99% of the TMD is, besides, significantly more resistant to unintentional initiation as compared with the same propellant in loosely packed form. Combined with the use of low-sensitive explosives, low vulnerability (LOVA, IM) may therefore be obtained.

The invention also relates to a propellant charge which is suitable for use in the method.

BRIEF DESCRIPTION OF DRAWINGS

The invention will now be described in more detail with reference to the accompanying Figures.

FIG. 12 illustrates a technique of preparing a propellant charge according to FIG. 9.

FIG. 13 is a sectional view, corresponding to FIG. 10, of an alternative embodiment of an inventive propellant charge.

FIG. 14 illustrates a technique of preparing a propellant charge according to FIG. 13.

DISCUSSION OF PREFERRED EMBODIMENTS

Figure 1:
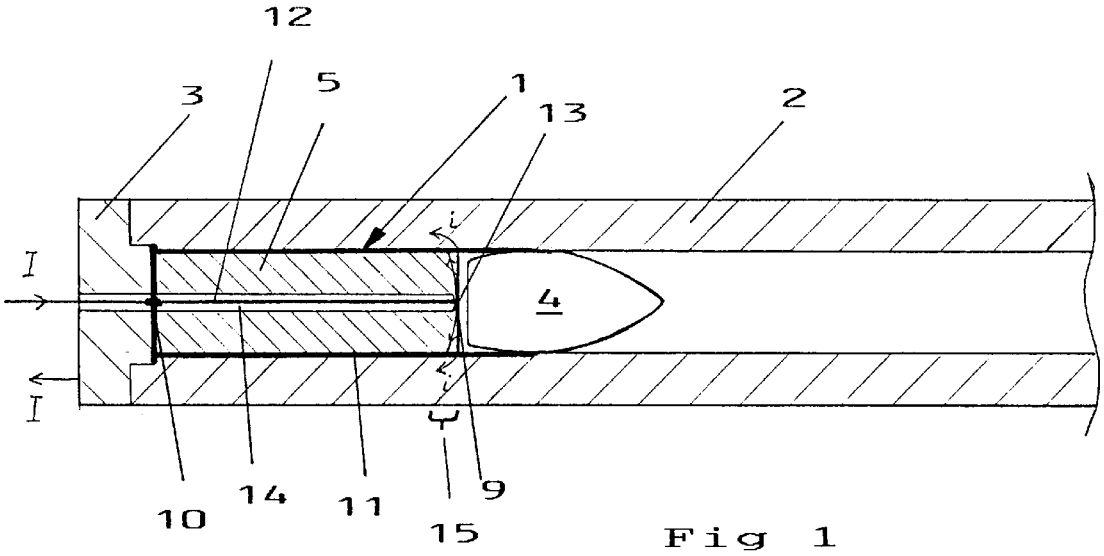
FIG. 1 is a schematic longitudinal section of a gun with a propellant charge according to the invention.

The corresponding details in the various Figures have been given the same reference numerals.

The propellant charge according to the invention contains a compact propellant 5 and electrically conductive surfaces 6, 7, 19 in the propellant, and means 12, 17, 21 for feeding electric current to said surfaces, thereby generating electrothermal energy in the propellant. The electrically conductive surfaces and/or the feeding means are arranged to conduct the current through different parts or zones 15, 16 of the propellant charge at different points of time during the burning.

The propellant can be solid, plastic or liquid, for example a gelled liquid, and may be, for instance, a composite propellant or a plastic-bonded explosive (PBX) based on explosive substances such as HMX, RDX, PETN, HNS, NTO, TNT, TNAZ, CL-20 (HNIW), NC or mixtures thereof. The propellant may have a charge density of 90–99% of the theoretical maximum density for the propellant.

Figures 3, 4:
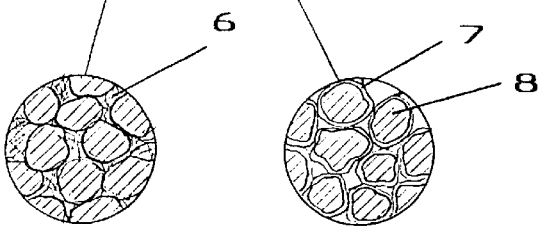
FIG. 3 is a sectional view of a detail of a propellant having electrically conductive surfaces in the form of fibres intermixed with the propellant.
FIG. 4 is a sectional view of a detail of a propellant having electrically conductive surfaces in the form of conductive layers applied to propellant particles.

The electrically conductive surfaces can be prepared by mixing fibres 6 of an electrically conductive material into the propellant (FIG. 3). The fibres may be, for example, metal fibres, carbon fibres or electrically conductive plastic fibres. In case the propellant consists of solid propellant particles 8, the electrically conductive surfaces can be prepared by applying electrically conductive layers 7 to or in the immediate vicinity of the solid propellant particles (FIG. 4). The applying can be effected by, for instance, admixing, spray painting, sputtering or vacuum deposition.

The electrically conductive surfaces may also consist of a thin, electrically conductive sheet material which is embedded and distributed in the propellant such that the propellant is arranged in thin layers between the surfaces of the sheet material. (FIGS. 9–15).

Primarily, the invention is intended for use in the acceleration of a projectile to a high velocity in a gun barrel and will below be described in such a context, but may also be generally used when it is desirable to control the burning in time and space, i.e. to control the burning rate and control the spreading of the deflagration through the charge from an initiation area.

FIG. 1 is a schematical longitudinal section of a gun having a gun barrel 2 and a breech 3, charged with a cartridge 1 comprising a projectile 4, a case 11 and a propellant charge according to the invention. The numeral 5 designates the compact propellant in which electrically conductive surfaces are distributed through the entire propellant body by intermixed fibres 6 or by applied layers 7 on propellant particles 8, which is illustrated in detailed views in FIG. 3 and FIG. 4, respectively. The propellant charge has an axial extent from a first end 9 facing the projectile 4, to a second end 10 facing the breech end 3, and is surrounded by a circumferential surface being in electrically conductive connection with the case 11. In this case, the case thus is made of an electrically conductive material. The means for feeding current to the conductive surfaces comprise a conductor 12 which is axially arranged in the propellant charge from a contact means at the rear of the case and has a free end 13 at the first end of the charge. The conductor is, up to its free end, enclosed by an insulator 14 which may consist of an explosive material. Current is supplied to the electrically conductive surfaces in the propellant from the free end 13 of the conductor and is conducted away through the gun barrel 2 via the case 11. The conductor is preferably made of aluminium and is consumed concurrently with the burning of the propellant.

In the proposed compact propellants for guns, the energy of the current pulse need to be roughly 50–150 kJ per kg of the propellant corresponding to about 1–3% of the combustion energy of the propellant to make the mass burning rate, dm/dt, sufficiently high.

The necessary electric energy can be supplied by an electric pulse power unit based on, for instance, energy storage in capacitors. The pulse unit is then estimated to weigh about 100–300 kg per kg charge weight of the propellant.

The propellant charge is initiated, starting over the free end face of the propellant facing the projectile 4 by a current pulse being fed through the conductor 12. The current seeks its way from the free end 13 of the conductor essentially radially out towards the gun barrel 2 leading off current, as indicated by arrows in FIG. 1. Thus, the current passes merely over the conductive surfaces within an axially restricted part 15 of the propellant charge. The burning occurs as end burning in the direction of the breech 3 of the gun, and the burning rate is controlled by current supply during the entire burning process.

When a current pulse is conducted through the propellant, the conductive surfaces are heated by so-called Joule heating. The supplied thermal energy $E_T$ is given by the expression $$E_T = R \cdot I^2 \cdot t$$

wherein R=resistance, I=current and t=time.

Ignition is initiated almost instantly on the surfaces of the propellant where the temperature is increased to some hundred Celsius degrees by the current pulse.

Figure 2:
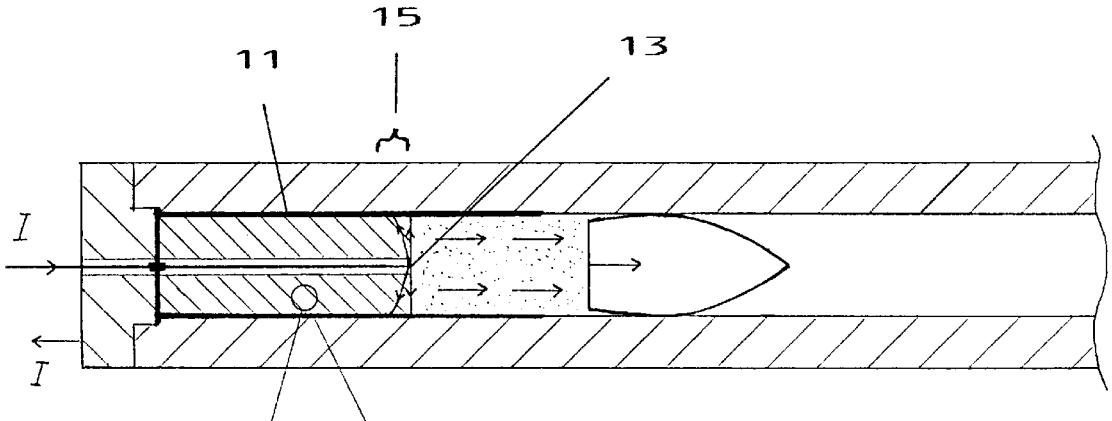
FIG. 2 is the same longitudinal section as in FIG. 1 shortly after ignition of the propellant charge.

FIG. 2 shows the same longitudinal section as FIG. 1 shortly after initiation of the propellant charge. The conductor 12 is consumed concurrently with the moving of the burning end face towards the back 3 of the gun. The distance occupied by the insulator 14, is bridged at the end 13 by a conductive plasma. The current is fed at each point of time over an axially restricted part 15 of the propellant charge. A higher current yields higher temperatures of the conductive surfaces in the propellant and, thus, a quicker reaction. The volume of propellant per unit of time, which is initiated, also increases with the current due to the fact that a larger volume of propellant reaches the ignition temperature and ignites. The mass burning rate is electrically controlled during the entire burning phase, thereby keeping the pressure in the reaction products at the pressure of design ($P_d$) for the gun barrel such that its strength is optimally utilised.

By this burning technique, the pressure drop is low in the area between the burning surface and projectile during the burning phase and the velocity of the reaction products between the burning surface and the projectile nearly equals the velocity of the projectile. As a consequence of this, the efficiency in the conversion from combustion energy in the propellant into kinetic energy in the projectile will be considerably higher than in a conventional propellant charge.

Figure 5:
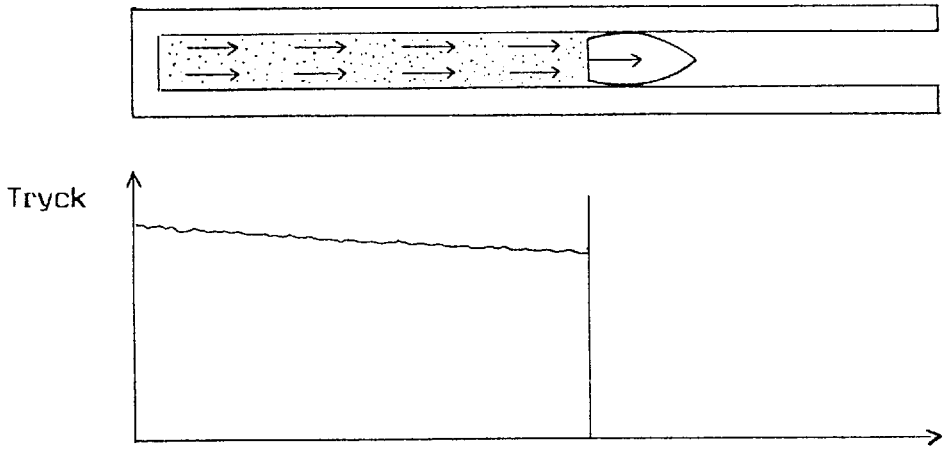
FIG. 5 shows the pressure and velocity conditions in the gun barrel after the propellant has just been completely combusted.

FIG. 5 schematically shows the pressure over the length of the gun barrel at the time when the propellant has just been completely combusted. The velocity and pressure of the reaction products are approximately constant in the entire gun barrel behind the projectile. To achieve this, the burning rate needs to be approximately proportional to the length of the charge, which has been burnt.

Figure 6:
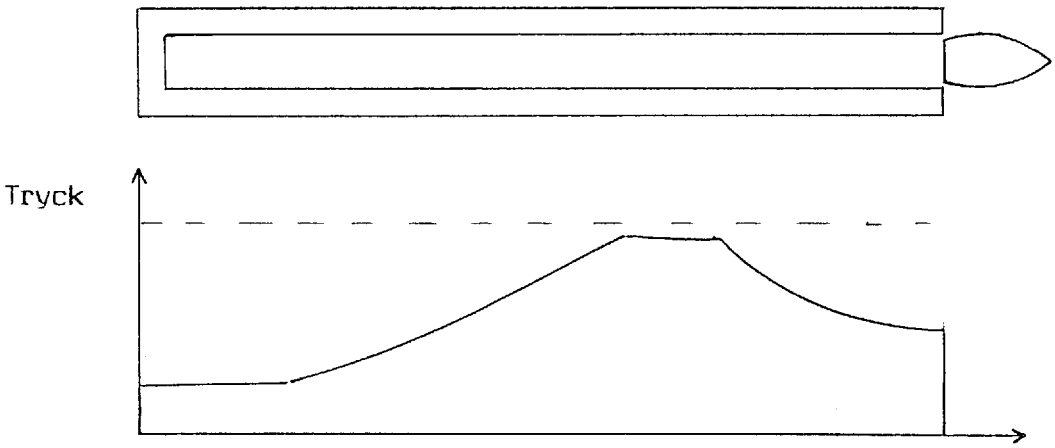
FIG. 6 illustrates the pressure conditions in the gun barrel as the projectile leaves the gun barrel.

FIG. 6 shows the pressure over the length of the gun barrel as the projectile leaves the gun barrel. From the position in which the propellant has been finally combusted, the reaction products expand approximately adiabatically and yield a pressure profile according to the Figure.

Figure 7:
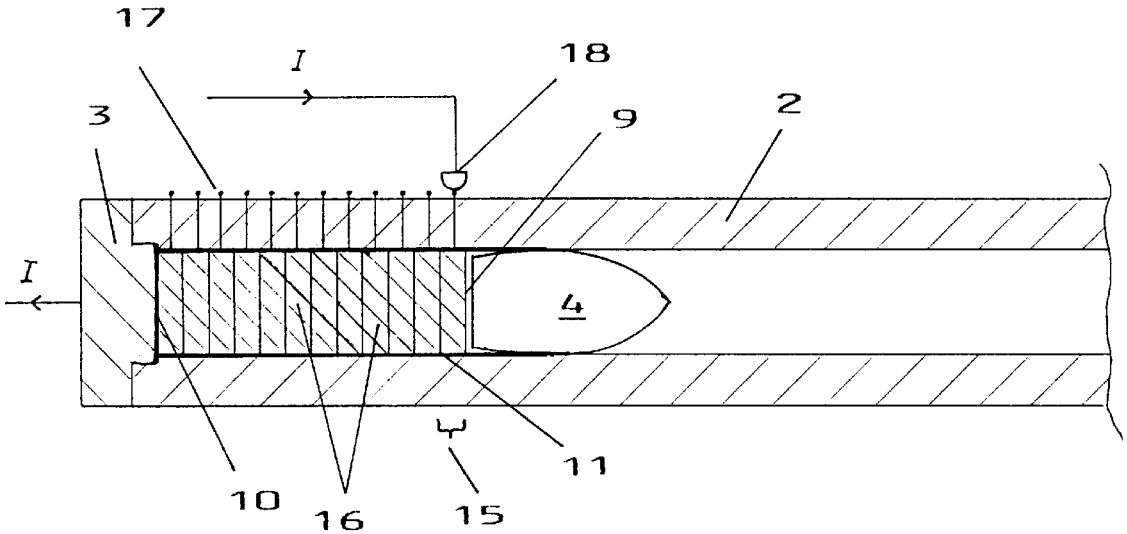
FIG. 7 is a schematic longitudinal view of a gun, like in FIG. 1, but in this case having a propellant charge consisting of several propellant charge units which are individually initiated.

FIG. 7 is a schematic longitudinal section of a gun like in FIG. 1, but in this case having a propellant charge comprising a succession of propellant charge units 16 having separate electrically conductive surfaces. When the propellant charge thus comprises several propellant charge units, the burning rate can be controlled by selecting the point of initiation for the different units. Each charge unit corresponds to a restricted axial part 15 of the charge from a first end 9 facing the projectile 4 to a second end 10 facing the back 3 of the gun. The electric current is supplied to the charge units one by one, starting at the first end 9 of the charge and then successively towards the second end 10 thereof, the interval between the current supply to each charge unit being selected. The means for feeding current to and from the conductive surfaces in the propellant comprise individual lead-ins 17 for electric current to the various charge units. The leading off of current can occur in different ways from positions in each charge unit through the case 11 to the gun barrel 2, or by a central lead-out to contact means in the rear of the case in a manner corresponding to that of the conductor 12 in FIGS. 1–2. The charge can be insulated from the case, or the case can be made of an electrically insulating composite material. The electrically conductive surfaces may consist of added fibres or layers on propellant particles as illustrated in FIGS. 3 and 4, or a thin, electrically conductive sheet material, which will be described in more detail with reference to FIGS. 9–15.

When initiating and controlling the burning of the propellant charge according to FIG. 7, current is conducted from a power unit to a control unit (in FIG. 7 illustrated as a trailing contact 18) which feeds the current to the lead-in of the respective charge unit in a selected time sequence. First, the first propellant charge unit in the series is connected, i.e. the one closest behind the projectile. In rapid succession, the remaining propellant charge units are then connected in turn backwards in the series.

By the development of heat in the electrically conductive surfaces in the propellant, the propellant mass is supplied with an electrothermal energy contribution which increases the burning rate of the propellant. In addition to the choice of the point of initiation for the various propellant charge units, the burning rate may thus be controlled by the power of the applied current.

Figure 8:
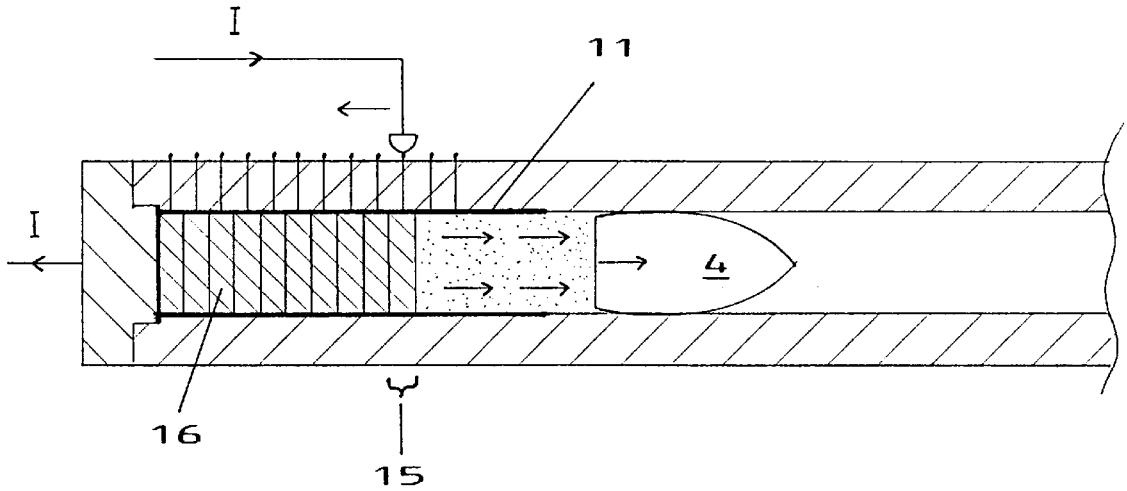
FIG. 8 is the same longitudinal section as FIG. 7 as a picture of the situation just after ignition of the propellant charge.

FIG. 8 is a picture of the situation immediately after initiating the burning. The charge units are successively initiated, and the mass burning rate of the propellant charge in its entirety is controlled by the electric pulses. By using a charge which consists of many propellant charge units 16, and selecting the points of initiation in a suitable manner, it is possible to achieve the pressure in the gun barrel being approximately constant during the burning phase, and the pressure on the rear of the projectile being kept high during the acceleration of the projectile in the gun barrel. A near constant velocity of the reaction products between burning surface and projectile, and a pressure distribution similar to the one described with reference to FIGS. 2, 5 and 6 are achieved.

Figure 9:
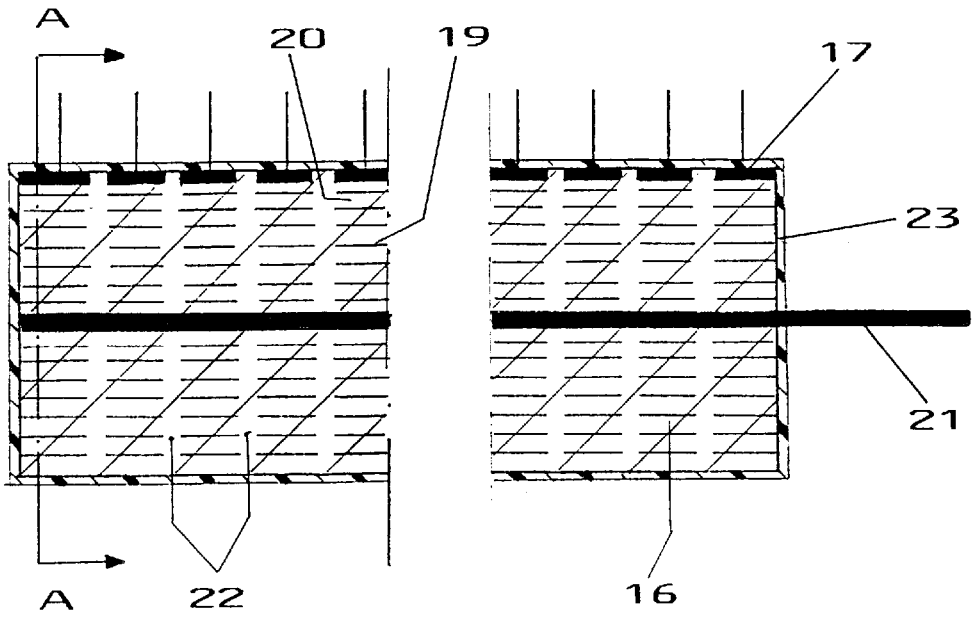
FIG. 9 is a longitudinal section of a propellant charge consisting of several propellant charge units.

FIG. 9 is a longitudinal section of an embodiment of a propellant charge comprising a succession of propellant charge units 16. The charge units may constitute separate units interconnected to a propellant charge, or be integrated parts in a coherent propellant body. In the latter case, the charge units are defined by axial portions having separate, electrically conductive surfaces. In the embodiment illustrated, the electrically conductive surfaces consist of a thin, electrically conductive sheet material 19, which is embedded and distributed in the propellant such that the propellant is present in thin layers 20 between sheet surfaces. Each unit comprises an individual lead-in 17, whereas the lead-out 21 is common to all units of the propellant charge. Between the different propellant charge units there is an insulating layer 22 of, for example, the same propellant as in the rest of the charge, but without electrically conductive surfaces or a corresponding material which is consumed as the charge burns. The propellant charge units 16 may thus be ignited individually by supplying current to the conductive sheet material 19 of each unit. The propellant charge can be fitted with an insulating covering 23 through which connections to the lead-ins are arranged.

Figure 10:
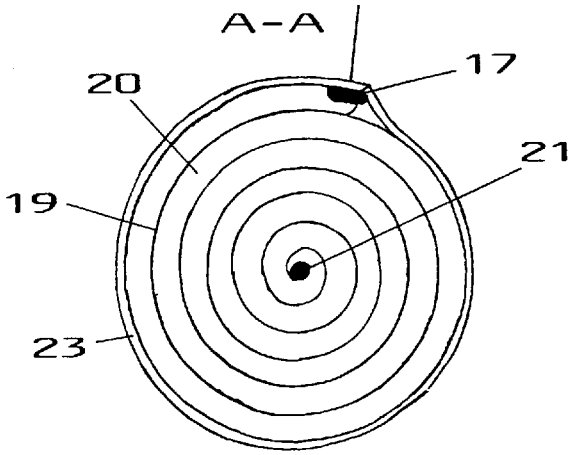
FIG. 10 is a sectional view of the propellant charge along line A—A in FIG. 9.

FIG. 10 is a cross-sectional view of the propellant charge along line A—A in FIG. 9. The electrically conductive sheet material 19 is helically wound with the thin, compact propellant layer 20 arranged between the different windings of the spiral. The conductor 17 is connected to one end of the sheet material 19 at the covering 23 of the propellant charge unit, and the lead-out 21 is connected to the other end thereof in the central portion of the charge. The lead-out extends axially away from the propellant charge.

Figure 11:
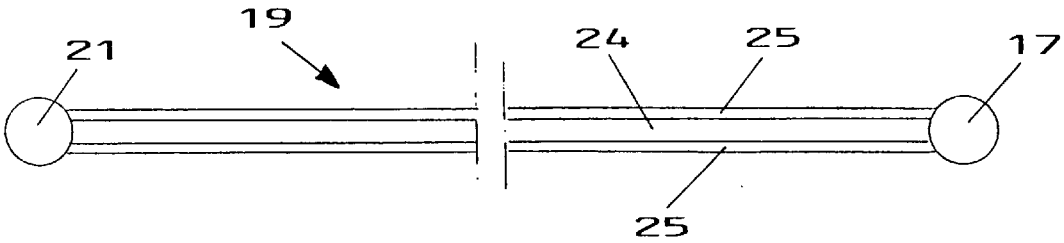
FIG. 11 is a longitudinal section of an embodiment of an electrically conductive sheet material for a propellant charge.

The sheet material 19 comprises a thin, electrically conductive layer 24 of, for instance, metal or carbon fibres, in the form of a foil, mat, net etc. An aluminium foil or a carbon fibre mat is especially preferred. FIG. 11 is a longitudinal section of an embodiment of a sheet material. Numberals 17 and 21 designate the lead-in and the lead-out for current, connected to the conductive layer 24. In view of the risk of flash-over between neighbouring parts of the electrically conductive layer, it is preferred that this has an insulating coating 25 of, for instance, a polymer. The insulating coating can be arranged on one side, or as shown in the Figure, on both sides of the conductive layer. In one embodiment of the invention, the conductive layer 24 comprises an aluminium foil, and the insulating coating 25 consists of PTFE (polytetrafluoroethylene). The sheet material may then be converted into useful energy in the charge, without significantly using the oxidant of the propellant. In the initiation, the aluminium reacts with PTFE as the oxidant while a large amount of energy develops.

The propellant charge can be prepared by casting a castable propellant in a casing in which the sheet material has been arranged in advance. Another technique of preparing a propellant charge according to FIGS. 9–10 is illustrated in FIG. 12. On a thin, mouldable layer of propellant charge, strips 26 of an electrically conductive sheet material 19 are arranged in parallel with each other and at a certain distance 27 from each other. Lead-ins 17 are connected to one end of each strip, and a lead-out 21 connects the other ends of the strips. The layer is then rolled in the longitudinal direction of the strips to a cylindrical propellant charge. The distance 27 between the strips will, in the finished charge, correspond to the insulating layer 22 (FIG. 9) between neighbouring propellant charge units. The propellant may consist of, for instance, a plastic propellant which can be worked to thin layers, or PBX or a composite propellant which has not yet finally cured. The sheet product and the rolling are made while the propellant is still soft and mouldable and the final curing is carried out in the rolled propellant charge. The propellant charge can then be provided with a protective insulating covering 23 (FIGS. 9, 10).

The propellant charge units may, of course, also be prepared one by one and assembled to a propellant charge.

To avoid the occurrence of inductance in the electrically conductive sheet material 19 when applying a current pulse over said material, the sheet material may be distributed in the propellant as illustrated in FIG. 13, i.e. as a doubled sheet with intermediate layers of propellant helically arranged in the propellant mass. The direction of current will then be different in two neighbouring windings of the resistance sheet.

FIG. 14 illustrates a technique of preparing a propellant charge unit according to FIG. 13. An elongate layered product 28 is, in this case, formed of two layers 29 and 30 of propellant and intermediate strips of an electrically conductive sheet material 19. The Figure is a longitudinal section of the layers. The strips are longer than the individual layers of propellant and are folded round one end of one propellant layer and are also placed against the other side of the propellant layer. Lead-ins 17 and a lead-out 21 for electric current are connected to the free ends of the strips. The thus-obtained layered product 28 is rolled to a cylindrical propellant charge unit. The layered product is rolled as indicated by the arrow in FIG. 14 such that the lead-ins 17 and the lead-out 21 are positioned in the outer part of the charge. The mutual positioning of the lead-ins and the lead-out on the outer surface of the propellant charge can be adapted by making the two propellant layers of different length as shown in FIG. 14. If the difference in length corresponds to II-R, wherein R is the radius of the ready propellant charge, the lead-in and the lead-out can be caused to be positioned diametrically opposite each other, as illustrated in FIG. 13.

Figure 15:
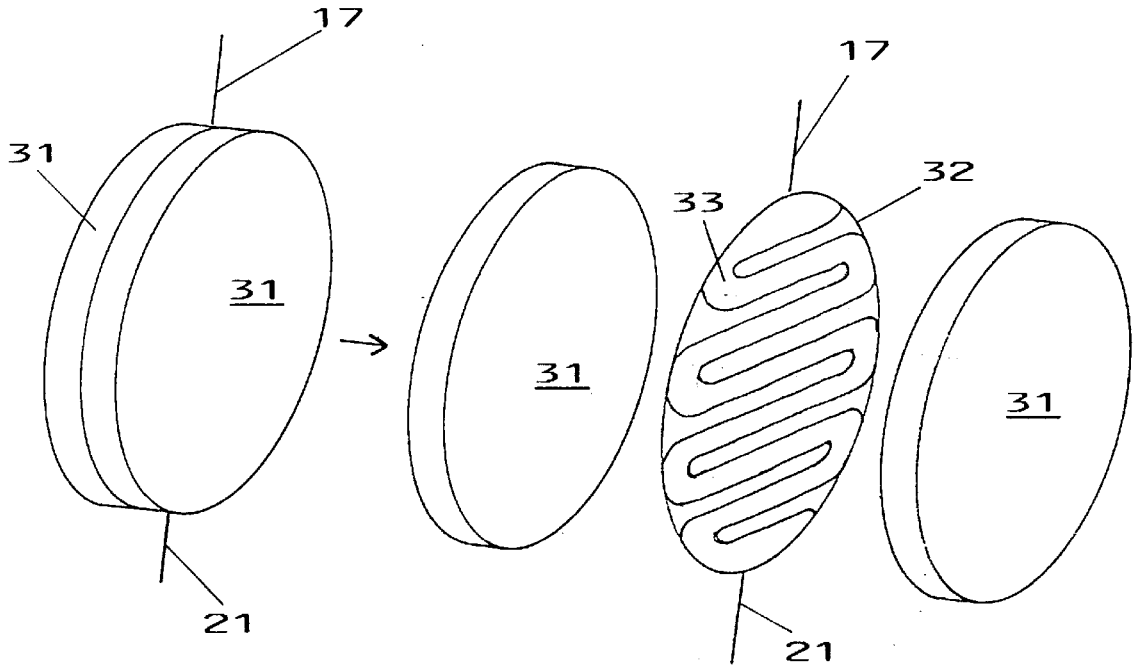
FIG. 15 illustrates an alternative technique of arranging an electrically conductive sheet material in a propellant charge according to the invention.

FIG. 15 illustrates the construction of a propellant charge consisting of discs 31 of a compact propellant and intermediate discs 32 of an electrically conductive sheet material. The Figure shows two propellant discs and one intermediate disc, assembled and, respectively, separated in their parts. A complete propellant charge may consist of a large number of discs according to this construction. The sheet material in the disc 32 may have an electrically conductive layer 33 of, for example, an aluminium foil which extends in a zigzag pattern in the sheet material and is insulated with a PTFE layer. A lead-in 17 and a lead-out 21 are connected each to one end of the electrically conductive layer 33.

When initiating a propellant charge unit with an embedded, electrically conductive sheet material, electric current is supplied to the conductive layer, with at least such strength that the burning of the propellant is initiated over the surface in contact with the sheet. If the propellant layer between the layers of sheet material is e.g. 1 mm, the propellant is consumed after the burning distance of 0.5 mm, which makes the burning rate of the entire propellant charge unit very high. By selecting the propellant thickness between the conductive layers, the burning rate of the propellant charge can be adapted to different purposes.

The burning rate of the propellant is affected by the amount of thermal energy supplied in the initiation. By supplying a stronger current pulse than is at least required for the initiation, it is possible to increase the burning rate. The burning that has begun can also be strengthened by supplying extra electrothermal energy. After initiation of burning, an electrically conductive plasma is formed in the most intensive part of the flame. As long as the lead-in and the lead-out for current are connected to the plasma, a continued supply of current can be effected, which increases the temperature and enhances the effect of the propellant. The fact that the electrically conductive layer is quickly burnt or gasified in the ignition thus does not prevent a continuous supply of current in order to electrothermally enhance the effect of the propellant.

We claim:

1. A method for electrically controlling the mass burning rate of a compact propellant charge, said method comprising initiating a burning of a compact propellant charge having a compact mass of propellant and an electrically conductive material dispersed therein, controlling the amount of propellant mass that is initiated at each point of time during said burning by feeding an electric current to said conductive material over a select zone of said mass, said current having sufficient power to instantly heat said zone to ignition temperature, and feeding said current to different selected zones of said mass at different points of time during said burning.

2. The method of claim 1 wherein said compact propellant comprises propellant particles having an electrically conductive surface layer thereon.

3. The method of claim 1 wherein said electrically conductive material comprises electrically conductive fibres which are distributed throughout the compact propellant mass.

4. The method of claim 1 wherein said electrically conductive material comprises a thin electrically conductive sheet which is embedded and distributed in the propellant mass such that propellant is interspersed in thin layers between sheet surfaces.

5. The method of claim 1 wherein said propellant charge has an axial extent from a first end to a second end and said burning is first initiated at said first end and said electrical current is fed, at each point of time, through an axially restricted zone of said propellant charge, beginning at said first end thereof and then successively towards said second end thereof.

6. The method of claim 5 wherein said electric current is fed through said axially restricted zone between a first conductor which is axially arranged in the propellant charge, and a second conductor which is surrounding said axial extent of said propellant charge.

7. The method of claim 5 wherein said propellant charge consists of a succession of charge units having separate electrically conductive surfaces and said electric current is fed to said charge units one by one at selected intervals.

8. The method of claim 5 wherein said propellant charge is for propelling a projectile from a weapon and said first end is facing the projectile and said second end is facing a breech of the weapon.

9. A method for electrically controlling the mass burning rate of a compact propellant charge which comprises forming a mass of propellant material into a generally elongated compact propellant charge having electrically conductive material dispersed axially therein, initiating and controlling the burning of said propellant material at each point of time during said burning by feeding an electric current initially at a first end of said charge over an axially restricted zone adjacent a projectile to be propelled by said charge, and successively feeding said current along said longitudinal charge to successive axially restricted zones toward a second end of said elongated charge, said current having sufficient power to instantly heat said propellant material in each said zones to ignition temperature.

10. The method of claim 9 wherein said propellant material comprises propellant particles having an electrically conductive surface layer thereon.

11. The method of claim 9 wherein said electrically conductive material comprises electrically conductive fibres which are distributed in the compact propellant material mass.

12. The method of claim 9 wherein said electrically conductive material comprises a thin electrically conductive sheet which is embedded and distributed in the propellant material mass with propellant material interspersed in thin layers between surfaces of said sheet.

* * * * *